US005533244A

United States Patent [19]

Wadzinski

[11] Patent Number: 5,533,244

[45] Date of Patent: Jul. 9, 1996

[54] WOVEN BELT PAPER POLISHER

[75] Inventor: Michael Wadzinski, Menasha, Wis.

[73] Assignee: Appleton Papers Inc., Appleton, Wis.

[21] Appl. No.: 263,199

[22] Filed: Jun. 21, 1994

[51] Int. Cl.[6] ..... B24B 39/00; D21F 3/08; D21G 1/02

[52] U.S. Cl. ..... 29/90.1; 29/90.01; 29/90.5; 493/467; 162/205; 162/288

[58] Field of Search ..... 29/90.01, 90.1, 29/90.2, 90.3, 90.5, 90.6, 90.7; 493/467 X; 162/204, 205 X, 288 X, 290, 305; 451/28, 299; 156/153

[56] References Cited

U.S. PATENT DOCUMENTS

| | | | |
|---|---|---|---|
| 56,457 | 7/1866 | Shepherd et al. | 29/90.1 |
| 333,533 | 8/1967 | Argonin | 29/90.1 |
| 424,995 | 4/1890 | Howell | 29/90.01 |
| 470,612 | 3/1892 | Wood | 29/90.01 |
| 1,123,968 | 1/1915 | Whitehouse | 29/90.01 |
| 1,679,711 | 8/1928 | Dawe | 29/90.1 |
| 1,842,848 | 1/1932 | Steffen | 29/90.1 |
| 1,970,227 | 8/1934 | Frisbie | 29/90.1 |
| 2,349,704 | 5/1944 | Clark | 92/68 |
| 2,635,509 | 4/1953 | Cowie et al. | 29/90.1 |
| 2,680,938 | 6/1954 | Peterson | 29/90.01 |
| 2,907,151 | 10/1959 | Peterson | 29/90.01 |
| 2,989,764 | 6/1961 | Peterson | 29/903.5 |
| 3,098,324 | 7/1963 | Straub | 29/90.01 |
| 3,592,732 | 7/1971 | Wand | 162/204 |
| 4,089,738 | 5/1978 | Kankaanpaa | 162/206 |
| 4,219,383 | 8/1980 | Valkama | 162/305 |
| 4,552,620 | 11/1985 | Adams | 162/358 |
| 4,832,772 | 5/1989 | Noguchi | 493/467 |
| 4,941,865 | 7/1990 | Skudrzyk | 493/467 |
| 5,080,759 | 1/1992 | Buzby | 162/158 |
| 5,178,729 | 1/1993 | Janda | 162/101 |
| 5,320,036 | 6/1994 | Krohn | 100/154 |
| 5,427,638 | 1/1995 | Goetz et al. | 156/153 |

OTHER PUBLICATIONS

Paper, vol. 186, No. 6, Sep. 20, 1976, pp. 351–355.
Tappi Journal, Mar. 1988, pp. 125–128.
Pleines, H. D., Conference, Coating for the '80s, Nov. 19, 1980 & Nov. 20, 1980.
R. Grant, Advances in Coating, PPI, vol. 25, No. 4, Apr. 1983, p. 43.
Glanzburstung Auf Grossen Moschinen, Der Papiermacher, pp. 123–125.
Brush Polishing of Board and Paper, Paper vol. 192, No. 4, Aug. 1979, pp. 167, 172.
"Smoothness and Glossiness on Coated Papers" from *Coating of Paper and Cardboard* by Kotte pp. 380–382 Apr. 1973.
"DOX Brush Finishing System" from *Papier* vol. 43, No. 9, Sep. 1989 p. 516 (Anon).

*Primary Examiner*—Jack W. Lavinder
*Assistant Examiner*—Christopher W. Day
*Attorney, Agent, or Firm*—Birch, Stewart, Kolasch and Birch

[57] ABSTRACT

A woven belt paper polisher imparts mechanical energy to paper by sliding a woven belt against a paper sheet while the sheet is supported against a shear inducing roll. The contact force, slide distance and the coefficient of friction of the polishing belt result in less polishing material wear, less chance for developing machine direction character on the paper surface, and less chance for machine component damage. The use of an extended belt run outside the polishing section, results in reduced wear, extended uptime, and better polishing surface reconditioning. The use of a commercially produced and modified woven paper machine fabric results in lower operating cost compared to the use of a specialty polishing material.

25 Claims, 3 Drawing Sheets

WOVEN BELT PAPER POLISHER

BACKGROUND OF THE INVENTION

1. Field of the Invention

The present invention relates to a method and apparatus for polishing paper. In particular, the method and apparatus utilize a polishing belt and cylinder in order to obtain the desirable properties that mechanical shear action imparts to paper. The present invention offers an optimal way to apply mechanical shear energy to paper without some of the drawbacks found with earlier devices.

2. Description of the Background Art

To impart mechanical energy to a paper surface, a frictional device is left with only three variables; contact force, sliding distance and the coefficient of friction of the frictional material. This relationship can be expressed as $E_m$=Nud where $E_m$=Mechanical energy, N=Normal or contact force, u=coefficient of friction of the polishing surface and d=sliding distance.

The devices considered to be the prior art are at either end of the spectrum, with respect to contact force and distance. These prior art devices have relatively low coefficients of friction for the frictional surface in most cases.

One prior art example uses brush polishing devices which rely on low contact forces and large slip distances. Surface speed differentials typically approach 15,000 feet per minute (fpm). Brush polishers are limited to material operating speeds of 1,500 fpm by mechanical limitations of the rapidly spinning brushes and bristle performance.

One prior art device disclosed in U.S. Pat. No. 4,089,738 to Kankaanpaa also describes stationary devices which drag hard surfaces against paper with higher contact forces compared to brush polishers. The slipping distances between differentials used in these relatively stationary devices are essentially directly related to web speed. Stationary frictional devices as described by Kankaanpaa generate tremendous heat and wear requiring the frictional surfaces to be made of steel or ceramic with relatively low coefficients of friction. The potential for scratching or the chance for developing a machine direction character on the paper is high because there is little opportunity to clean the device during operation, the polishing surface is very hard and the speed differentials are still relatively high (2,500 to 5,000 fpm).

An invention described in U.S. Pat. No. 2,349,704 to Clark uses soft rollers with a polishing powder to develop a high coefficient of friction between the paper and the frictional device. This relatively high coefficient of friction device along with relatively high speed differentials results in micro-scratching with presumably low contact forces.

SUMMARY OF THE INVENTION

Accordingly, it is a primary object of the present invention to exploit the middle ground in imparting mechanical energy to paper via friction and to use a cost effective polishing material by modifying a product already economically and routinely produced in the paper industry.

It is another object of the present invention to provide a wear surface of the polishing material which can be extended to large distances resulting in a large quantity of material being available for wear.

It is yet another object of the present invention to provide a belt device which can develop sufficient belt tension to produce a polishing pressure of 1 to 30 psi.

It is a further object of the present invention to provide a belt which can wrap a cylindrical backing roll to give an extended contact/working length which increases the dwell time of the paper while it is being worked on by the belt.

Another object of the present invention is to provide extended working lengths which allow for the use of relatively small speed differentials between the paper and the belt.

It is yet another object of the present invention to provide extended working lengths of a belt device which allow for higher machine speeds compared to rotary brushes or roll polishing devices.

It is still another object of the present invention to provide a belt device having a very large percentage of its length available for cleaning, conditioning and static control when not working on the paper.

It is another object of the present invention to provide a frictional type paper polishing device which is able to efficiently dissipate heat produced during the polishing process.

These and other objects of the present invention are fulfilled by providing a woven belt paper polisher having a cylindrical roll and a polishing belt disposed around a arcuate portion of a cylindrical polishing roll. An arcuate portion of a length of paper is guided between the cylindrical polishing roll and the polishing belt such that relative movement of the polishing belt with respect to the length of paper results in polishing the paper.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
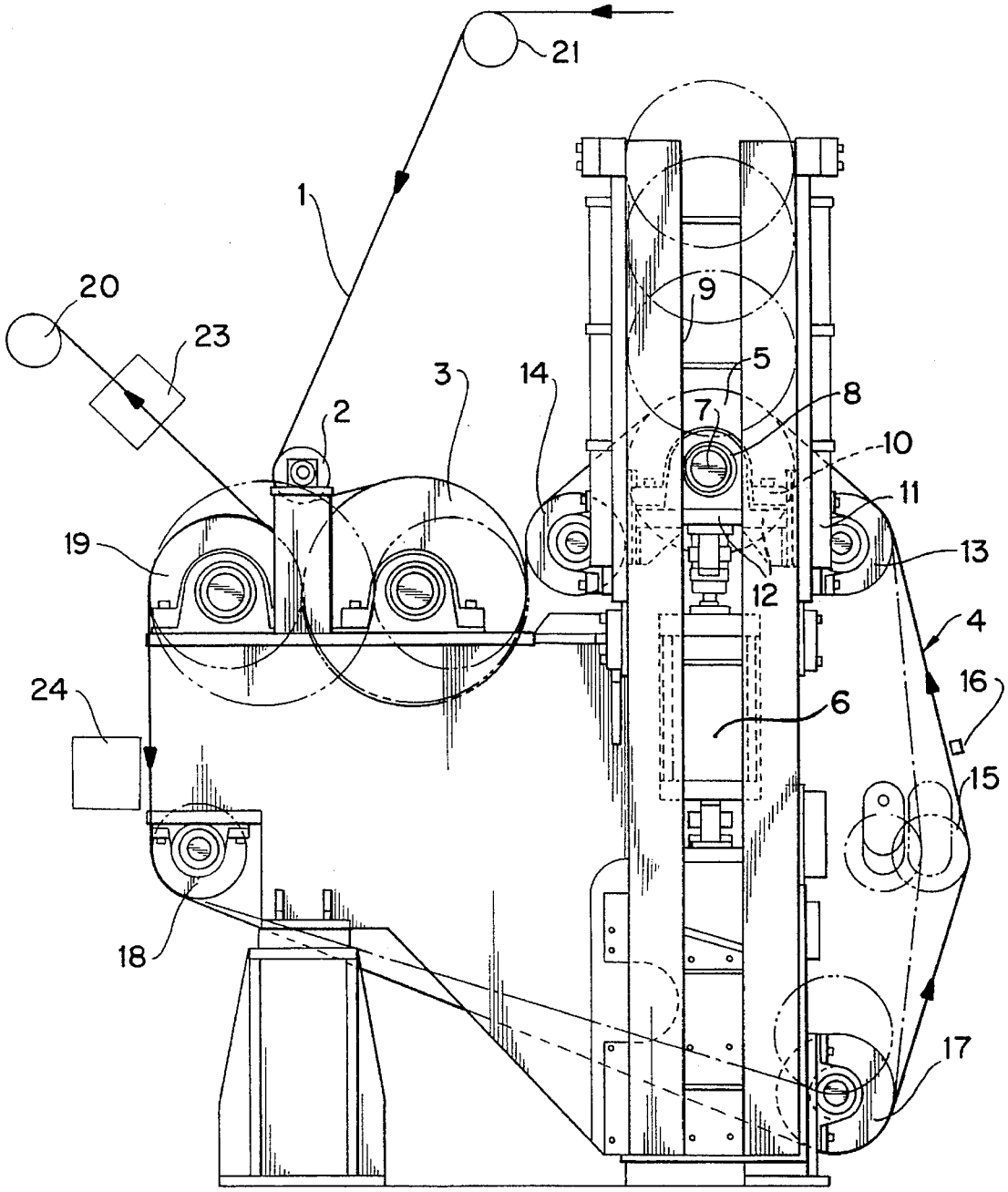
FIG. 1 is a side elevation view of the apparatus of the present invention.
Figure 2:
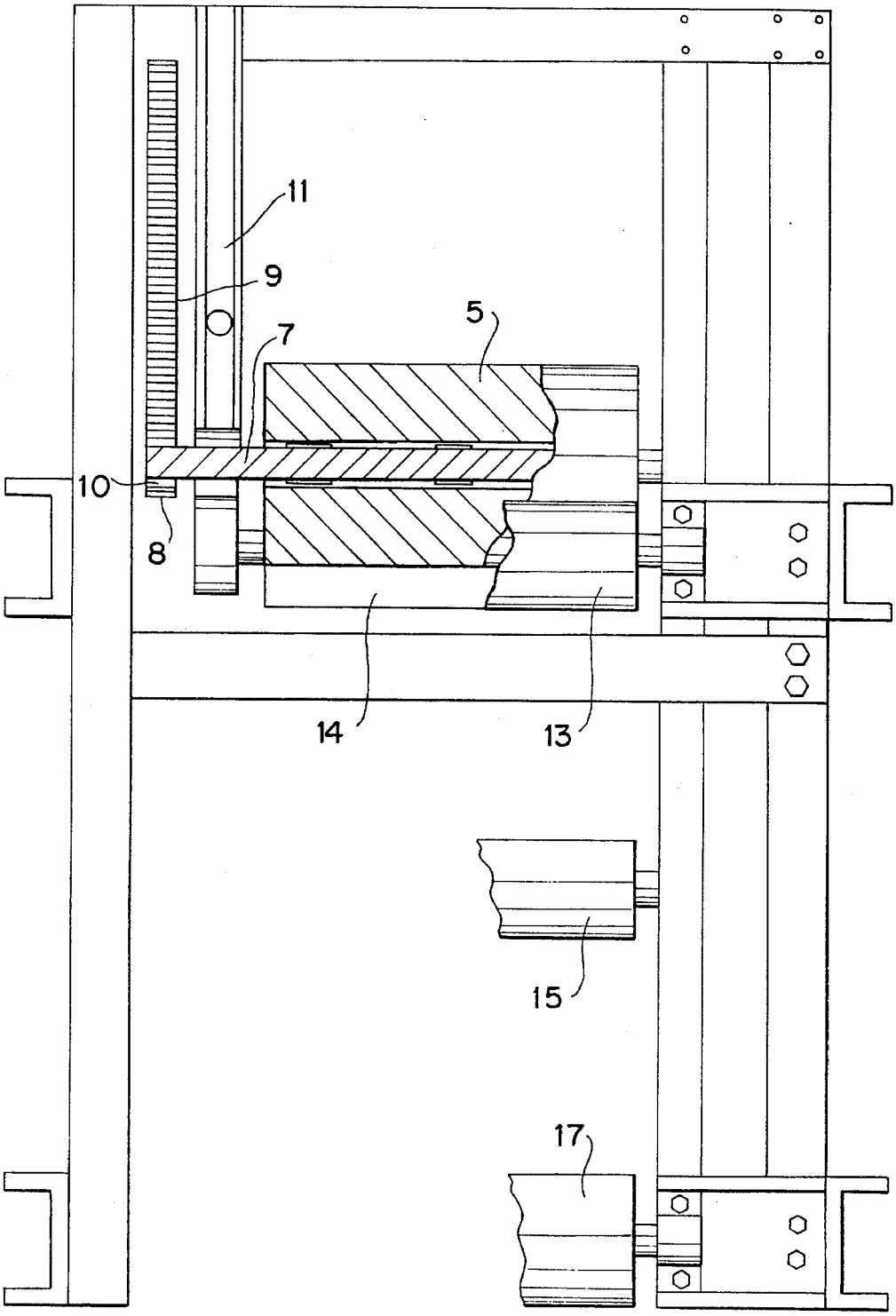
FIG. 2 is a partial section view of the present invention cut along the line II—II as shown in FIG. 3.
Figure 3:
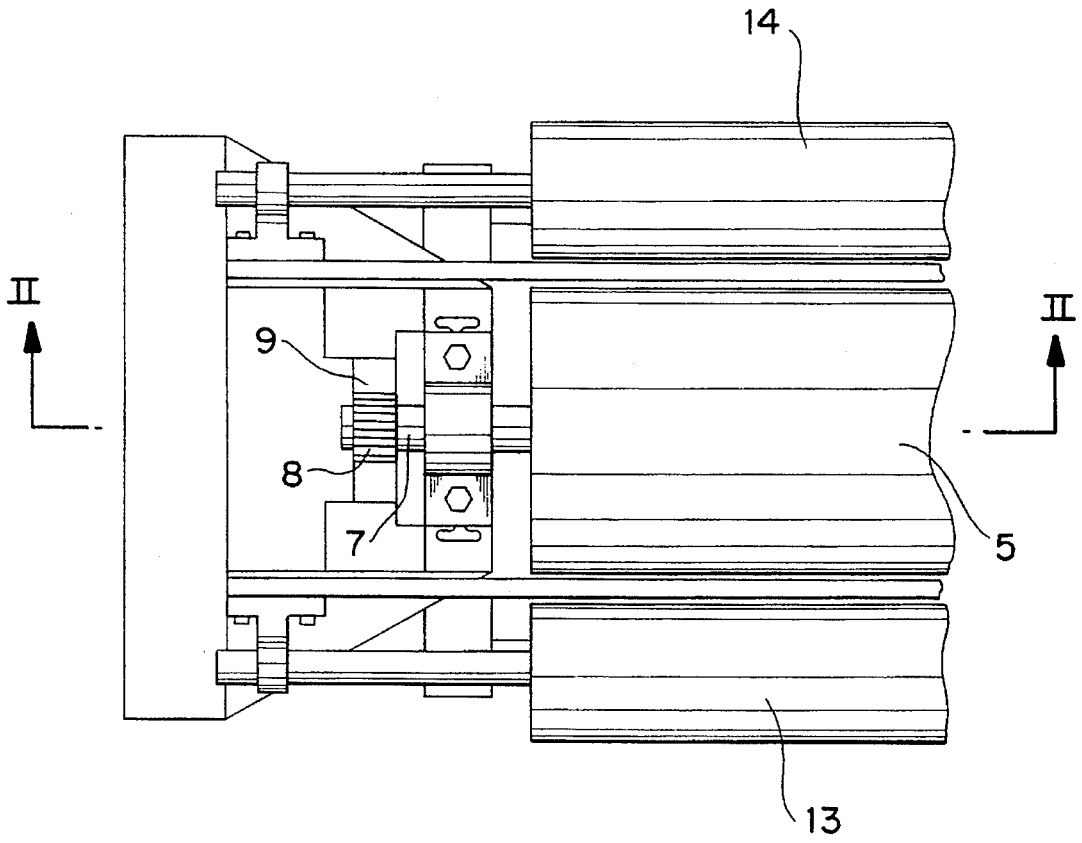
FIG. 3 is a partial top view of the present invention.

Referring in detail to FIGS. 1–3 and with particular reference to FIG. 1, a woven belt paper polisher arrangement is shown, according to the present invention.

The arrangement has a paper sheet 1 which contacts a carrying roll 2 before wrapping around a cylindrical polishing shear inducing roll 3. The cylindrical shear inducing roll 3 is covered with a polyurethane layer to prevent slippage of the paper sheet 1 while in contact with the cylindrical shear inducing roll 3. This material may be made of rubber, urethane, or other synthetic polymer materials, that offer high coefficient of friction, flexibility, resiliency and resist "glazing" or loss of coefficient of friction through mechanical friction. As the paper sheet 1 rotates with and at the same speed as the shear inducing roll 3, a polishing belt 4 is brought into contact with the side of the paper sheet 1 to be polished.

The polishing belt 4 is in the general form of a paper machine press fabric with a woven underlayer to maintain the fabric's integrity under high tensions (greater than 200 pounds per linear inch or pli). The woven underlayer is impregnated with a dense batting of natural, synthetic, or metallic fibers or filaments which act as the polishing medium. Polishing is carried out by sandwiching an arcuate portion of the paper sheet 1 between the shear inducing roll 3 and the polishing belt 4. If the polishing belt 4 is driven at a different speed relative to the paper sheet 1, the polishing belt 4 will preferentially slip against the sheet 1 while wrapped around the shear inducing roll 3 since the coefficient of friction is lower for the surfaces of the polishing belt 4 and the paper sheet 1, as compared to the surfaces of the rubber coated shear inducing roll 3 and the paper sheet 1 at any normal force applied to the shearing inducing roll 3 by the tension of the polishing belt 4.

The tension is developed in the polishing belt 4 by the extension of the tensioning roll 5 to increase the length of the belt path. Four different tensioning roll positions are also shown in FIG. 1. The tensioning roll 5 is moved by two pneumatic or hydraulic pistons 6 at both ends of the tensioning roll axle 7. The tensioning roll 5 is a "dead shaft" roll allowing it to freely rotate about the tensioning roll axle 7. The position of roll 5 is controlled in the "z" axis by maintaining equal pressure on both pistons 6 during operation. A pair of pinion gears 8 and toothed racks 9 are provided at each end,of the tensioning roll axle 7. The gears 8 and racks 9 maintain the alignment of the tensioning roll 5 in the vertical plane with respect to the shear inducing roll 3. The horizontal position of the tensioning roll 5 is controlled by guiding each bearing block 10 between a pair of guide rails 11 that are mated to the bearing block mounting bracket 12 by means of "T" slots that couple the roll 5 to the mounting bracket 12 while allowing the bracket 12 to move only in the vertical plane.

Two idler rolls 13, 14 are positioned on bearing blocks 10 to maintain the same resultant tension on both the ingoing and outgoing side of the belt tensioning roll 5 to prevent the tensioning roll 5 from binding in the guide rails 11. A belt guiding device 15 is used to keep the polishing belt 4 centered with respect to the shear inducing roll 3. The belt guiding device 15 pivots around the midpoint of the roll face in a plane substantially parallel to the polishing belt 4. Two different operating positions are shown in FIG. 1. The belt position is determined with a sensor 16 and the polishing belt 14 is then automatically directed by pivoting roll 15 to steer the belt 4 back in the proper position. The speed of the polishing belt 4 is controlled by regulating the speed of roll 19 with electric drives or mechanical brakes. This roll 19 should be covered with a rubber-like surface or high friction surface to prevent slippage with respect to the polishing belt 4.

The polishing belt carrying rolls 14, 5, 13, 15, 17, 18 and 19 and the shear inducing roll 3 must be sufficiently stiff to prevent deflection under belt tensions of up to 250 pli. The speed of the paper sheet 1 is controlled by driving the shear inducing roll 3 independently of roll 19 that drives the polishing belt 4. Rolls 20,21 carry the sheet and are not driven.

Devices to clean the paper sheet 1 and remove static electricity may be installed as shown by reference numeral 23. Devices to clean and remove static from the polishing belt 4 may be installed as shown by reference numeral 24. Of course, the exact positioning of either cleaning device 23 or 24 could be moved from the illustrated position. It is simply necessary for these devices 23, 24 to be adjacent to the paper sheet 1 and belt 4, respectively at some point. Both the cleaning and static devices are commercially available.

These static and cleaning devices may use the following or a combination of the following to clean the web or paper: ionized air jets, brushes, vibration, ion emitters.

The belt may also be cleaned with sprays of cleaning water or solvents if means for drying the belt are used after application.

The polishing device of the present invention is designed to provide for a wide range of polishing pressures against the shear inducing roll 3 and a wide range of speed differentials between the paper sheet 1 and the polishing belt 4.

The use of a belt to impart frictional energy to paper is advantageous because of at least the following reasons. First, the wear surface of the polishing material of the polishing belt 4 can be extended to large distances around the cylindrical polishing backup/shear inducing roll 3 which results in a large quantity of material available for wear. Inherently, such a belt 4 would take longer to wear and the life of the belt would be prolonged. Further, the polishing belt 4 can wrap around the shear inducing roll 3 extending the contact/working length and thereby increasing the dwell time of the paper while it is being worked on by the polishing belt. The above described extended working lengths also allow for the use of relatively small speed differentials between the paper sheet 1 and the polishing belt 4. These small speed differentials reduce the chances for developing a machine direction character in the paper by scratching or dragmarks. Lab scaled trials indicate that drag distances of 2 inches to 15 inches should be suitable to create the desired results. This length is less than the length for a rotary brush or roller arrangement operating at a web speed of 1,500 fpm which would require 16 inches to 26 feet of brush or roller contact length to produce similar results achieved by the present belt method.

The extended working lengths of a belt device according to the present invention also allow for higher machine speeds compared to rotary brushes or roll polishing devices. For the device of the present invention, operational paper speeds are approximately 2,500 to 3,500 feet per minute with polishing belt speeds of 1,500 to 3,200 feet per minute. In contrast, rotary brush or roll polishers are limited to operating paper speeds of less than 1,500 feet per minute with roll or brush speeds of 3,000 to 15,000 feet per minute.

As described previously, a belt device has a very large percentage of its length available for cleaning, conditioning and static control when not working on the paper. In contrast, a roll device has a very limited "not in use" fraction of its circumfrential length available for reconditioning or cleaning.

Furthermore, permeable belts can be cleaned or treated from both sides and are able to dissipate more heat since there is more time for them to cool when they are not working on the paper compared to a rotary cylinder device. These factors reduce belt wear and keep maintenance costs low.

Using a paper machine press felt belt, similar to but modified for effective polishing with a woven underlayer and a batted top layer to impart mechanical energy to a paper sheet by means of friction, is advantageous because paper machine fabrics of this type are designed and manufactured to operate on machines in the same lengths and widths that would be considered optimal for a large commercial scale paper polisher. These fabrics are designed to withstand tensions of 500 to 1,200 pli before breaking. The operating tensions of the present device are estimated to be between 50 and 300 pli. Operating tensions of these fabrics greater than 80 pli and up to 300 pli have been demonstrated for the first time in developing this machine and process. However, normal operating tensions for these fabrics are generally about 20 pli and in rare cases as high as 60 pli to 80 pli.

Furthermore, the batting material can be made of various compositions to optimize the frictional action on the paper. The batted fiber surfaces are also softer than steel or ceramic surfaces of conventional rolls or plates which is advantageous in producing a more uniform effect on the paper while reducing contact pressure and preventing scratching. Furthermore, the woven and needled construction of these fabrics allow them to resist wear better than a strictly non-woven fabric.

The tensile strength of woven machine fabrics allows a moderate contact force/pressure to be developed against the paper and cylindrical backup roll. The contact pressure needed for optimal polishing is estimated to be between 1 and 30 psi developed against the cylindrical shear inducing roll 3.

The invention being thus described, it will be obvious that the same may be varied in many ways. These variations may include multi-stage operation and arrangements to polish both sides of the sheet by repeating this basic operation. Such variations are not to be regarded as a departure from the spirit and scope of the invention, and all such modifications as would be obvious to one skilled in the art are intended to be included within the scope of the following claims.

I claim:

1. A method of polishing paper, comprising the steps of:

feeding a length of paper at a first speed around an arcuate portion of a cylindrical roll;

passing a polishing belt against the arcuate length of the paper at a second speed, the arcuate length of paper being pressed between the polishing belt and the cylindrical roll, wherein the first and second speeds are different;

polishing the paper with the polishing belt when the paper is in contact with the polishing belt during the step of passing, the paper moving relative to the polishing belt during the step of selectively controlling an amount of movement of the paper relative to the polishing belt in order to vary a degree of polishing of the paper being selectively variable during the step of controlling.

2. The method of polishing paper according to claim 1, further including the step of maintaining an operating tension on the polishing belt.

3. The method of polishing paper according to claim 1, further including the step of cleaning said paper sheet after said polishing step.

4. The method of polishing paper according to claim 1, further including the step of removing static electricity from said paper sheet after said polishing step.

5. The method of polishing paper according to claim 1, further including the step of cleaning said polishing belt while said belt is in operation.

6. The method of polishing paper according to claim 1, further including the step of removing static electricity from said polishing belt while said belt is in operation.

7. The method of polishing paper according to claim 1, further including the step of tensioning the polishing belt to at least 200 pounds per linear inch.

8. A paper polishing apparatus for polishing paper comprising:

a polishing roll, around which an arcuate portion of a length of paper is guided;

a polishing belt, the polishing belt extending past the polishing roll, said arcuate portion of a length of paper on the polishing roll being between the polishing roll and the polishing belt;

means for driving the polishing roll; and means for driving the polishing belt with relative movement between the polishing belt and said arcuate portion of a length of paper on the polishing roll to thereby polish said arcuate portion of a length of paper.

9. The paper polishing apparatus as in claim 8, further comprising belt tensioning means for maintaining a tension in said polishing belt.

10. The paper polishing apparatus as in claim 9, wherein said belt tensioning means includes a belt tensioning roll in engagement with said polishing belt and means for providing a force on said belt tensioning roll for tensioning said polishing belt.

11. The paper polishing apparatus as in claim 10, wherein said means for providing a force of said belt tensioning roll includes a hydraulic piston assembly.

12. The paper polishing apparatus as in claim 10, wherein said means for providing a force of said belt tensioning roll includes a pneumatic piston assembly.

13. The paper polishing apparatus as in claim 8, wherein said polishing roll has a surface with a greater coefficient of friction than a surface of said polishing belt.

14. The paper polishing apparatus as in claim 13, wherein said polishing roll has a polyurethane surface.

15. The paper polishing apparatus as in claim 8, further comprising means for cleaning said paper sheet.

16. The paper polishing apparatus as in claim 8, further comprising means for removing static electricity from said paper sheet.

17. The paper polishing apparatus as in claim 8, further comprising means for cleaning said polishing belt.

18. The paper polishing apparatus as in claim 8, further comprising means for removing static electricity from said polishing belt.

19. The paper polishing apparatus as in claim 8, wherein said polishing belt is made of a woven fabric.

20. The paper polishing apparatus as in claim 19, wherein said woven fabric is impregnated or needled into or attached with batting material made up of synthetic fibers.

21. The paper polishing apparatus as in claim 8, wherein said means for driving includes a belt carrying roll having a high friction surface.

22. The paper polishing apparatus as in claim 19, wherein said woven fabric is impregnated or needled into or attached with batting material made up of natural fibers.

23. The paper polishing apparatus as in claim 8, wherein the means for driving the polishing roll and the means for driving the polishing belt are independently driven whereby an amount of movement of the polishing belt and the paper are selectively adjustable.

24. The paper polishing apparatus as in claim 8, wherein the polishing belt is tensionable to at least 200 pounds per linear inch.

25. A method of polishing paper, comprising the steps of:

feeding a length of paper at a first speed around an arcuate portion of a cylindrical roll;

passing a polishing belt against an arcuate length of the paper at a second speed, the arcuate length of paper being pressed between the polishing belt and the cylindrical roll wherein the first and second speeds are different, and the paper and the polishing belt move in a same direction; and polishing the paper with the polishing belt when the paper is in contact with the polishing belt during the step of passing, the paper moving relative to the polishing belt during the step of polishing.

* * * * *